US012510067B2

(12) United States Patent
Imai

(10) Patent No.: US 12,510,067 B2
(45) Date of Patent: Dec. 30, 2025

(54) TUBE PUMP WITH PROTRUDING PART TO PREVENT MOVEMENT OF THE TUBE INTO THE GEARS

(71) Applicant: Surpass Industry Co., Ltd., Saitama (JP)

(72) Inventor: Hiroshi Imai, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 7 days.

(21) Appl. No.: 18/429,037

(22) Filed: Jan. 31, 2024

(65) Prior Publication Data

US 2024/0263627 A1 Aug. 8, 2024

(30) Foreign Application Priority Data

Feb. 2, 2023 (JP) ..... 2023-014527

(51) Int. Cl.
*F04B 43/12* (2006.01)

(52) U.S. Cl.
CPC ..... *F04B 43/1253* (2013.01); *F04B 43/1261* (2013.01)

(58) Field of Classification Search
CPC ..... F04B 43/1253; F04B 43/1261
See application file for complete search history.

(56) References Cited

U.S. PATENT DOCUMENTS 2,696,173 A 12/1954 Jensen
2,826,993 A 3/1958 McChesney
2,987,004 A * 6/1961 Murray ..... F04B 43/1261 417/477.12
4,288,205 A * 9/1981 Henk ..... F04B 43/1253 417/477.12
2021/0239108 A1 8/2021 Imai

FOREIGN PATENT DOCUMENTS

JP 2003-021050 A 1/2003
JP 2021121738 A 8/2021
WO WO-2012076173 A2 * 6/2012 ..... F04B 43/1276

OTHER PUBLICATIONS

Extended European Search Report for EP Application No. 24155336.1 dated May 7, 2024.

* cited by examiner

*Primary Examiner* — Mary A Davis
(74) *Attorney, Agent, or Firm* — Meunier Carlin & Curfman LLC

(57) ABSTRACT

Provided is a tube pump including: an accommodation unit accommodating a pair of roller units and having a tube arranged therein; and a pair of drive units that rotate the pair of roller units, respectively. The outer circumferential face of a roller has a first gear area provided with a first gear, a first tube area contacted with the tube, and a groove area with a groove formed about the roller axis. The inner circumferential face of the accommodation unit has a second gear area provided with a second gear, a second tube area that pinches and closes the tube, and a protruding area with a protruding part formed about the axis. The pair of roller units rotate about the axis with the protruding part accommodated in the groove. The tip of the protruding part is arranged at a position more projecting toward the axis than the second gear.

7 Claims, 13 Drawing Sheets

TUBE PUMP WITH PROTRUDING PART TO PREVENT MOVEMENT OF THE TUBE INTO THE GEARS

CROSS-REFERENCE TO RELATED APPLICATIONS

This application claims foreign priority benefits under U.S.C. § 119 to Japanese Patent Application No. 2023-014527 filed on Feb. 2, 2023, the contents of which is hereby incorporated by reference in its entirety.

BACKGROUND

Technical Field

The present disclosure relates to a tube pump.

Description of Related Art

Conventionally, a tube pump that intermittently collapses a flexible tube by a plurality of rollers to press-feed a liquid out of the tube is known (for example, Japanese Patent Application Laid-Open No. 2021-121738). The tube pump disclosed in Japanese Patent Application Laid-Open No. 2021-121738 has a structure in which both the first roller unit and the second roller unit that rotate about an axis while being in contact with the tube can independently rotate about the axis.

Further, when the operator accidentally touches a part near the first roller unit and the second roller unit with its hand when both the first roller unit and the second roller unit are rotating about the axis, the operator's finger may be caught between the first roller unit and the second roller unit. Otherwise, when the part near the first roller unit and the second roller unit is covered so that the operator is unable to touch these roller units with its hand, this will sacrifice easy replacement of the tube.

In the tube pump disclosed in Japanese Patent Application Laid-Open No. 2021-121738, a cover member is arranged in an accommodation unit where the tube is arranged so as to provide a circular ring-shaped opened area where the tube can be inserted toward the inner circumferential face of the accommodation unit. Thus, this prevents the operator's finger from being caught between the pair of roller units. Further, since the tube can be inserted from the opening area toward the inner circumferential face of the accommodation unit, the operator may easily replace the tube.

In the tube pump disclosed in Japanese Patent Application Laid-Open No. 2021-121738, by providing gears that engage with the inner circumferential face of the accommodation unit and the outer circumferential face of the pair of roller units, respectively, it is possible to improve the positioning accuracy of the pair of roller units by reducing the misalignment of the pair of roller units about the axis. A gear area in which the gears are formed and a tube area against which the tube is pressed by the pair of roller units are formed on the inner circumferential faces of the accommodation unit, respectively.

However, when the tube is deformed such as when the tube to be attached to the tube pump is partially twisted, the tube attached to the tube pump may be arranged in the gear area instead of the tube area. When the tube is arranged in the gear area, the tube is unable to be properly collapsed by the pair of roller units. Thus, when the tube is arranged in the gear area, work to remove the tube from the tube pump and then restore the deformation of the tube to the original shape is required.

BRIEF SUMMARY

The present disclosure has been made in view of such circumstances and intends to provide a tube pump that enables a tube to be reliably arranged at a position where the tube can be collapsed by a pair of roller parts even when the tube is deformed such as when the tube to be attached to the tube pump is partially twisted.

The present disclosure employs the following solutions to solve the above problems.

The tube pump according to one aspect of the present disclosure includes: a pair of roller units configured to rotate about an axis while being in contact with a flexible tube; an accommodation unit accommodating the pair of roller units and opened toward one end side in an axis direction along the axis, the flexible tube being arranged in the accommodation unit; and a pair of drive units configured to rotate the pair of roller units in the same direction about the axis, respectively, each of the roller units includes a roller configured to rotate about a roller axis, an outer circumferential face of the roller is configured to include a first gear area in which a first gear is formed, a first tube area to be contacted with the tube, and a groove area in which a groove is formed about the roller axis between the first gear area and the first tube area in the axis direction, the accommodation unit includes an inner circumferential face formed in a shape of a circular arc about the axis, the inner circumferential face of the accommodation unit is configured to include a second gear area in which a second gear configured to engage with the first gear is formed, a second tube area configured to pinch and close the tube between the first tube area and the second tube area, and a protruding area in which a protruding part is formed about the axis between the second gear area and the second tube area in the axis direction, the pair of roller units is configured to rotate about the axis with the protruding part being accommodated in the groove, and a tip of the protruding part is arranged at a position more projecting toward the axis than the second gear.

According to the tube pump of one aspect of the present disclosure, the pair of roller units rotate about the axis in a state where the first gear formed in the first gear area of the roller and the second gear formed in the second gear area of the accommodation unit are engaged with each other. Because the first gear and the second gear are engaged with each other, the roller can be rotated about the roller axis in the opposite direction to the rotation direction of the roller units when the pair of roller units rotate about the axis. Accordingly, it is possible to prevent a failure that the roller in contact with the tube pushes the tube in the rotation direction of the roller unit and causes the tube to be deformed. Further, the tube is pinched and closed between the first tube area of the roller and the second tube area of the accommodation unit, and thereby a liquid in the tube can be transported in the rotation direction about the axis of the pair of roller units.

Further, according to the tube pump of one aspect of the present disclosure, the protruding part is formed in the protruding area between the second gear area and the second tube area of the accommodation unit, and the tip of the protruding part is arranged at a position more projecting toward the axis than the second gear. Thus, when the tube is deformed such as when the tube to be attached to the tube pump is partially twisted, even when the tube inserted in the accommodation unit is forced to move from the second tube area toward the second gear area, such motion is prevented by the protruding part. Thus, even when the tube is deformed such as when the tube attached to the tube pump is partially twisted, the tube can be reliably arranged at a position where the tube can be collapsed by the pair of roller units.

In the tube pump according to one aspect of the present disclosure, the tube pump is preferably configured such that the projecting length of the tip of the protruding part from the second gear area is more than or equal to twice the tooth depth of the second gear.

According to the tube pump of the present configuration, it is possible to more reliably prevent the tube inserted in the accommodation unit from moving from the second tube area toward the second gear area.

In the tube pump according to one aspect of the present disclosure, the tube pump is preferably configured to include a cover member covering the pair of roller units and arranged in the accommodation unit so as to provide a circular ring-shaped opening area into which the tube is to be inserted toward the inner circumferential face.

According to the tube pump of the present configuration, the cover member is arranged in the accommodation unit so as to provide the circular ring-shaped opening area into which the tube can be inserted toward the inner circumferential face. This prevents the operator's finger from being caught between the pair of roller units. Further, since the tube can be inserted from the opening area toward the inner circumferential face of the accommodation unit, the operator may easily replace the tube.

In the tube pump according to one aspect of the present disclosure, the tube pump is preferably configured to include a control unit configured to control each of the pair of drive units, and the control unit is configured to perform a first control mode to rotate the pair of roller units in the same direction so as to discharge a fluid out of the tube and a second control mode to fix respective rotation angles of the pair of roller units so that the pair of roller units do not come into contact with the tube.

According to the tube pump of the present configuration, the control unit performs the second control mode, thereby the pair of roller units are arranged at retracted positions where both of the pair of roller units are not in contact with the tube. This enables easy replacement of the tube in use with another tube.

In the tube pump according to one aspect of the present disclosure, the tube pump is preferably configured such that the protruding part is formed in an area other than a non-formation area about the axis and that the non-formation area is an area interposed between the pair of roller units in the second control mode, the tube being not arranged in the non-formation area.

According to the tube pump of the present configuration, the non-formation area where the protruding part is not formed is an area which is pinched by the pair of roller units whose rotation angles are fixed in the second control mode and in which the tube is not arranged. Since the protruding part is formed in an area where the tube is arranged, it is possible to suitably prevent the tube inserted in the accommodation unit from moving from the second tube area toward the second gear area in the second control mode.

In the tube pump of the above configuration, a preferable form is such that, in the second control mode, both ends in a circumferential direction about the axis of the protruding part are accommodated in the groove of each of the pair of roller units.

According to the tube pump of the present aspect, since both the ends in the circumferential direction about the axis of the protruding part are accommodated in respective grooves of the pair of roller units, motion of the tube from the non-formation area toward the second gear area can be reliably prevented by the pair of roller units.

In the tube pump according to one aspect of the present disclosure, the tube pump is preferably configured to include a lid unit configured to be switched between a closed state where the lid unit covers the accommodation unit and an open state where the lid unit is separated from the accommodation unit; a detection unit configured to detect the open state and the closed state of the lid unit; and a control unit configured to control each of the pair of drive units, and the control unit is configured to control the pair of drive units to stop when the detection unit detects that the lid unit is in the open state.

According to the tube pump of the present configuration, since the lid unit covers the accommodation unit in the closed state, it is possible to reliably prevent a problem of the operator accidentally touching a part near the pair of roller units with its hand and thereby its finger being caught therebetween. Further, since the pair of drive units are stopped when the detection unit detects that the lid unit is in the open state, the pair of roller units do not rotate about the axis in a state where the operator may touch a part near the pair of roller units. Accordingly, it is possible to prevent the operator's finger from being caught between the pair of roller units.

According to the present disclosure, it is possible to provide a tube pump that enables a tube to be reliably arranged at a position where the tube can be collapsed by a pair of roller units even when the tube is deformed such as when the tube to be attached to the tube pump is partially twisted.

DETAILED DESCRIPTION

Figure 1:
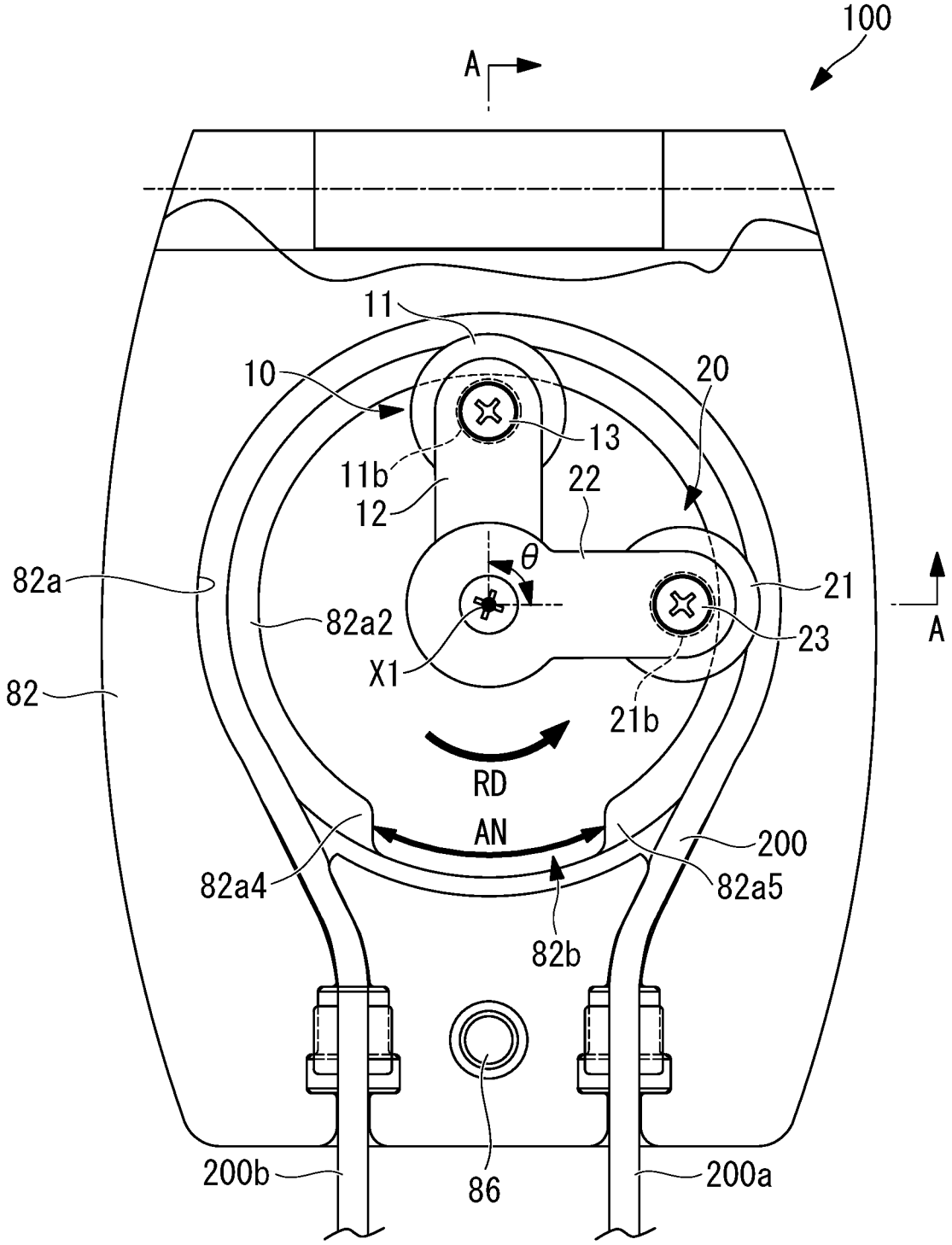
FIG. 1 is a plan view illustrating one embodiment of a tube pump in a discharge control mode.
Figure 2:
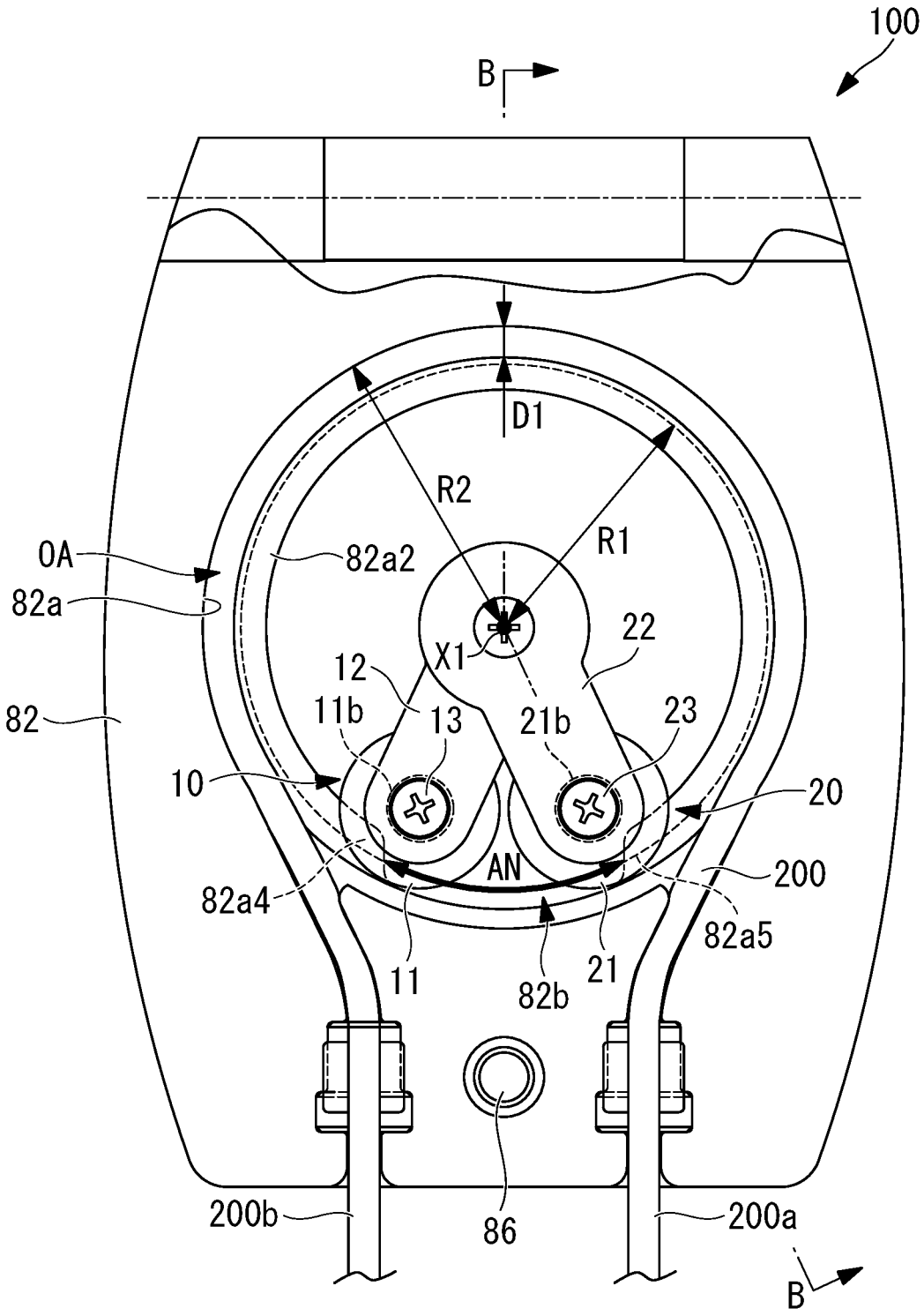
FIG. 2 is a plan view illustrating one embodiment of the tube pump in a tube replacement mode.
Figure 4:
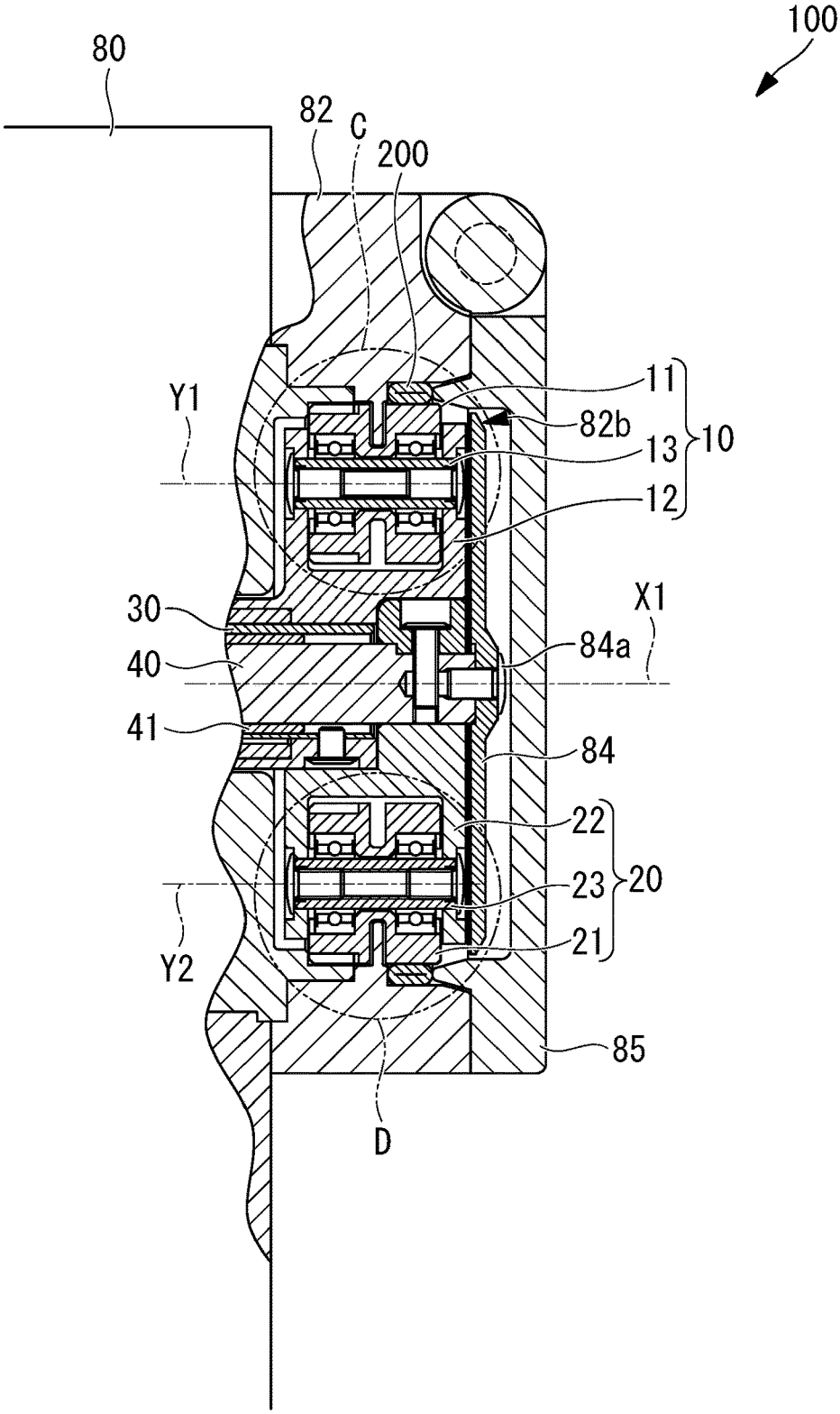
FIG. 4 is a longitudinal sectional view of the tube pump viewed from the arrow direction of the line A-A of FIG. 1.

A tube pump (peristaltic pump) 100 of one embodiment of the present disclosure will be described below with reference to the drawings. FIG. 1 is a plan view illustrating one embodiment of the tube pump 100. FIG. 2 is a plan view illustrating one embodiment of a tube pump in a tube replacement mode. In FIG. 1 and FIG. 2, illustration of a cover member 84 and a lid unit 85, which are illustrated in FIG. 4 and the like, is omitted.

The tube pump 100 of the present embodiment illustrated in FIG. 1 is a device for rotating a first roller unit 10 and a second roller unit 20 in the same direction about an axis X1 (a first axis) to discharge a fluid in a tube 200 flowing in from an inflow side 200*a* to an outflow side 200*b*. The tube 200 is formed of a flexible resin material (for example, polyvinyl chloride (PVC)).

As illustrated in the plan view of FIG. 1, the tube 200 is arranged in a shape of a circular arc about the axis X1 along an inner circumferential face 82*a* of an accommodation unit 82 that accommodates the first roller unit 10 and the second roller unit 20 in the tube pump 100. The inner circumferential face 82*a* is a surface that is formed in a shape of a circular arc about the axis X1 and in which the tube 200 is arranged. The accommodation unit 82 is opened toward one end side in the axis direction along the axis X1 and has a recess 82*b* that accommodates the first roller unit 10 and the second roller unit 20.

As illustrated in FIG. 1, the first roller unit 10 and the second roller unit 20 accommodated in the accommodation unit 82 rotate about the axis X1 along a counterclockwise rotation direction (direction indicated by the arrow in FIG. 1) while being in contact with the tube 200.

Figure 3:
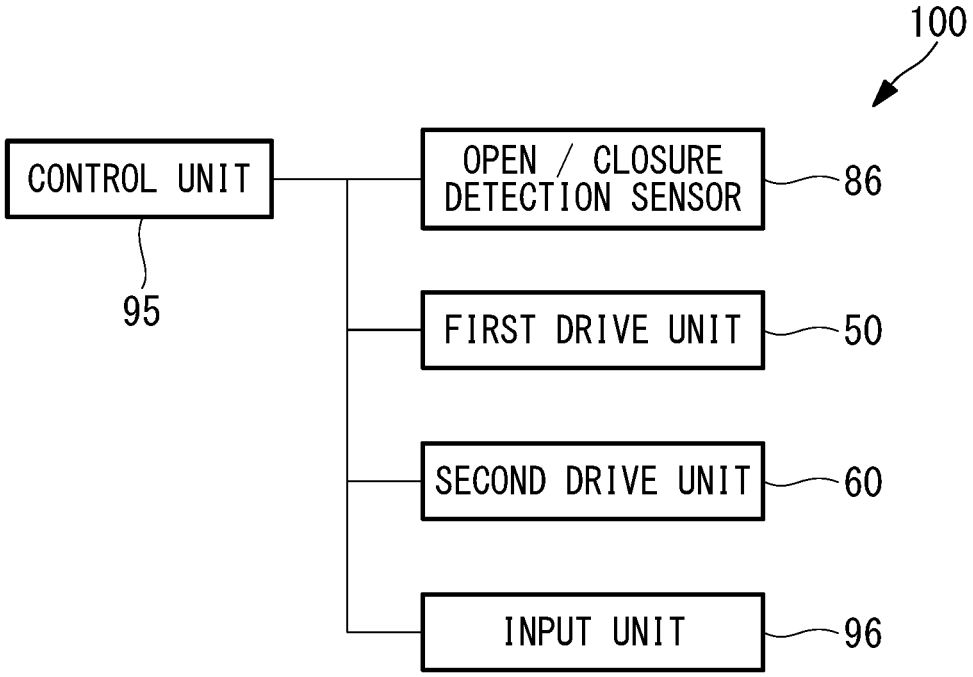
FIG. 3 is a block diagram illustrating a control configuration of the tube pump.

FIG. 3 is a block diagram illustrating a control configuration of the tube pump 100. As illustrated in FIG. 3, the tube pump 100 of the present embodiment includes a first drive unit 50 configured to rotate the first roller unit 10 in the rotation direction RD about the axis X1, a second drive unit 60 configured to rotate the second roller unit 20 in the rotation direction RD about the axis X1, a control unit 95 configured to control the first drive unit 50 and the second drive unit 60, and an input unit 96 used for inputting operation instructions to the tube pump 100 by the operator. The first drive unit 50 and the second drive unit 60 rotate the first roller unit 10 and the second roller unit 20, respectively, in the same direction along the rotation direction RD about the axis X1.

Further, the tube pump 100 includes an open/closure detection sensor 86 configured to detect whether the lid unit 85 described later is in an open state or in a closed state. When the open/closure detection sensor 86 detects that the lid unit 85 is in the open state and a signal indicating the open state is transmitted from the open/closure detection sensor 86, the control unit 95 controls the first drive unit 50 and the second drive unit 60 to stop.

FIG. 4 is a longitudinal sectional view of the tube pump 100 viewed from the arrow direction of the line A-A of FIG. 1. As illustrated in FIG. 4, the tube pump 100 of the present embodiment includes the first roller unit 10 and the second roller unit 20 that are rotated about the axis X1 in a state where the tube 200 is closed, a drive cylinder 30 connected to the first roller unit 10, and a drive shaft 40 arranged on the axis X1 and connected to the second roller unit 20. The first drive unit 50 transfers driving force of an electrical motor (not illustrated; for example, a pulse motor) to the drive cylinder 30 and rotates the drive cylinder 30 about the axis X1. The second drive unit 60 transfers driving force of an electrical motor (not illustrated; for example, a pulse motor) to the drive shaft 40 and rotates the drive shaft 40 about the axis X1.

The drive cylinder 30 is supported rotatably about the axis X1 on the outer circumferential side of the drive shaft 40 by a cylindrical bearing member 41 inserted along the inner circumferential face. A first roller supporting member 12 of the first roller unit 10 is connected to the tip side of the drive cylinder 30 to rotate together about the axis X1. The driving force for rotating the drive cylinder 30 about the axis X1 by the first drive unit 50 is transferred to the first roller unit 10 via the first roller supporting member 12.

The drive shaft 40 is supported rotatably about the axis X1 on the inner circumferential side of the drive cylinder 30 by the cylindrical bearing member 41 inserted along the outer circumferential face. The drive shaft 40 rotates smoothly about the axis X1 in a state where the central axis is held on the axis X1. The second roller supporting member 22 of the second roller unit 20 is connected to the tip side of the drive shaft 40 so as to rotate together about the axis X1. The driving force for rotating the drive shaft 40 about the axis X1 by the second drive unit 60 is transferred to the second roller unit 20 via the second roller supporting member 22.

Figure 5:
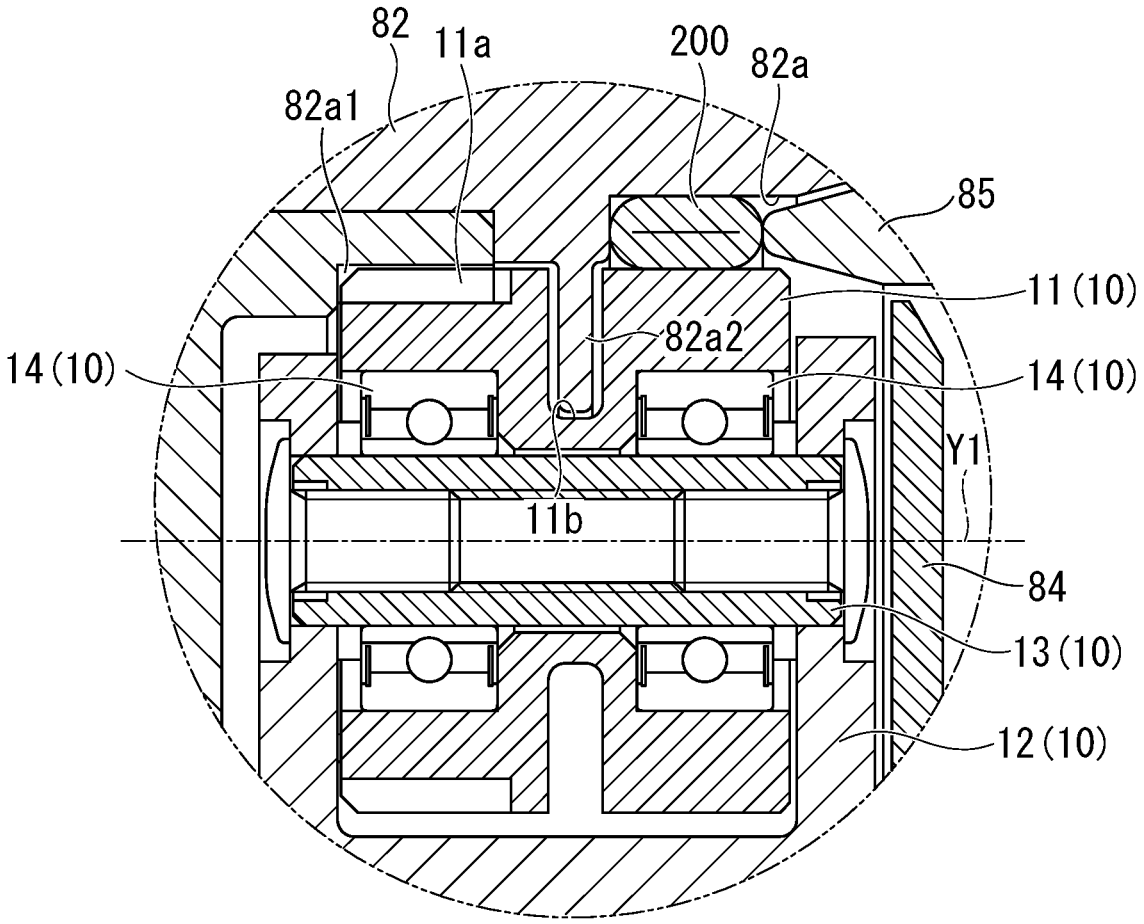
FIG. 5 is a partial enlarged view of a part C of the tube pump illustrated in FIG. 4.

FIG. 5 is a partial enlarged view of the part C of the tube pump 100 illustrated in FIG. 4. As illustrated in FIG. 4 and FIG. 5, the first roller unit 10 has the first roller 11 that rotates about the roller axis Y1 parallel to the axis X1 while being in contact with the tube 200, the first roller supporting member 12 connected to the drive cylinder 30 to rotate together about the axis X1, a first roller shaft 13 whose both ends are supported by the first roller supporting member 12 and that attaches the first roller 11 in a rotatable manner, and a pair of ball bearings 14. The ball bearings 14 support the first roller 11 rotatably about the roller axis Y1 with respect to the first roller shaft 13.

The first drive unit 50 rotates the first roller unit 10 about the axis X1 in the counterclockwise rotation direction RD. The first roller supporting member 12 is connected to the first drive unit 50 and rotates counterclockwise about the axis X1 while supporting the first roller 11.

Figure 6:
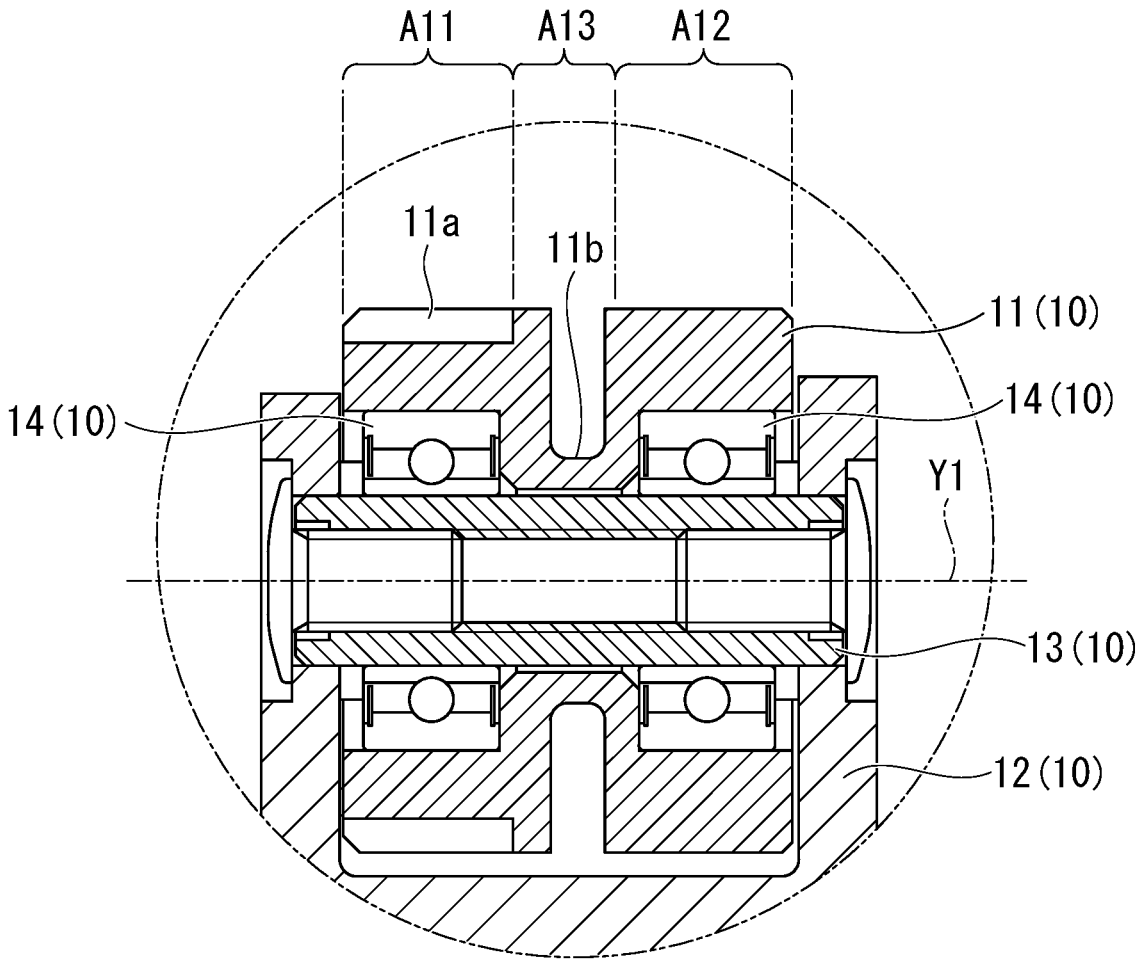
FIG. 6 is a sectional view of a first roller unit illustrated in FIG. 5.

FIG. 6 is a sectional view of the first roller unit 10 illustrated in FIG. 5. As illustrated in FIG. 5 and FIG. 6, the outer circumferential face of the first roller 11 about the roller axis Y1 has a first gear area A11 in which a first gear 11*a* is formed, a first tube area A12 to be in contact with the tube 200, and a groove area A13 in which a groove 11*b* is formed over the whole circumference about the roller axis Y1. The groove area A13 is an area interposed between the first gear area A11 and the first tube area A12 in the direction along the roller axis Y1.

Figure 7:
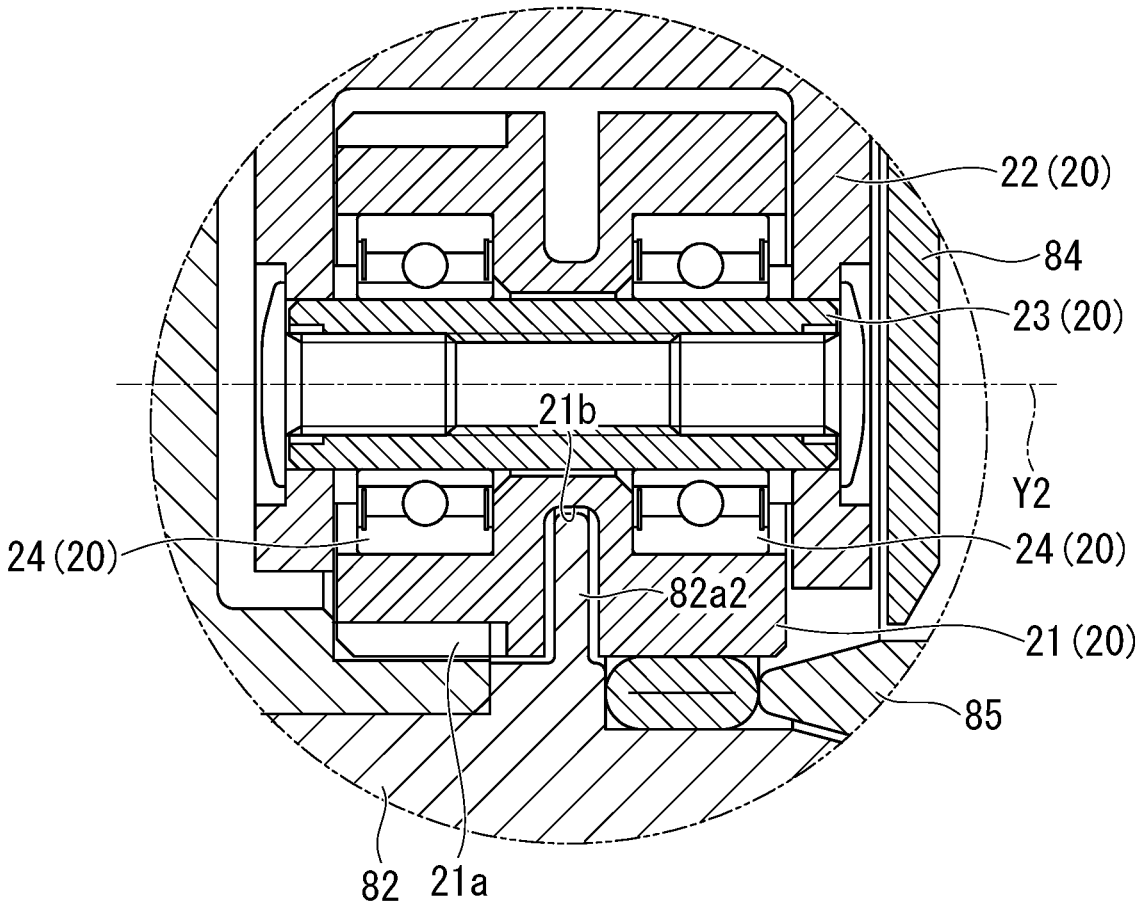
FIG. 7 is a partial enlarged view of a part D of the tube pump illustrated in FIG. 4.

FIG. 7 is a partial enlarged view of the part D of the tube pump 100 illustrated in FIG. 4. As illustrated in FIG. 4 and FIG. 7, the second roller unit 20 has the second roller 21 that rotates about the roller axis Y2 parallel to the axis X1 while being in contact with the tube 200, the second roller supporting member 22 connected to the drive shaft 40 so as to rotate together about the axis X1, a second roller shaft 23 whose both ends are supported by the second roller supporting member 22 and that attaches the second roller 21 in a rotatable manner, and a pair of ball bearings 24. The ball bearings 24 support the second roller 21 rotatably about the roller axis Y2 with respect to the second roller shaft 23.

The second drive unit 60 rotates the second roller unit 20 about the axis X1 in the counterclockwise rotation direction RD. The second roller supporting member 22 is connected to the second drive unit 60 and rotates counterclockwise about the axis X1 while supporting the second roller 21.

Figure 8:
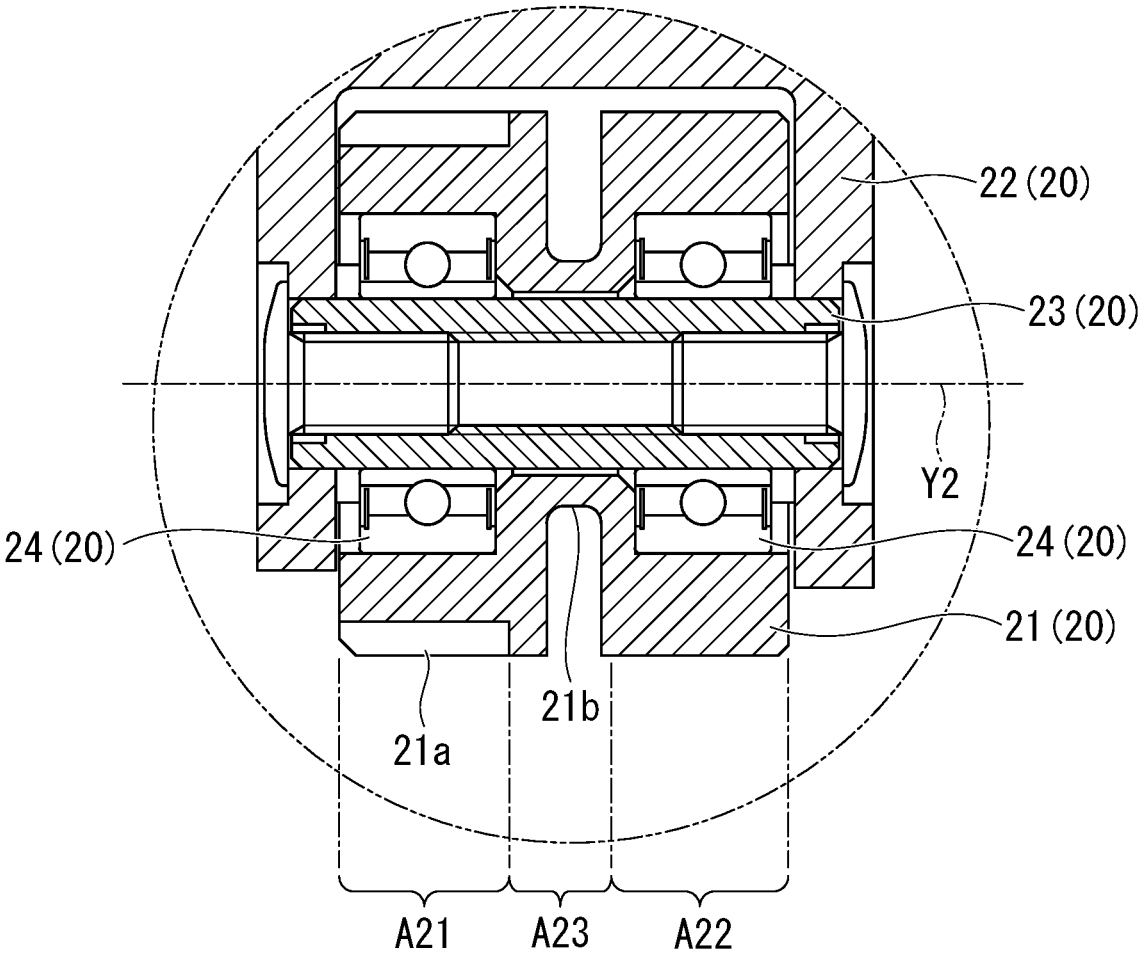
FIG. 8 is a sectional view of a second roller unit illustrated in FIG. 7.

FIG. 8 is a sectional view of the second roller unit 20 illustrated in FIG. 7. As illustrated in FIG. 7 and FIG. 8, the outer circumferential face of the second roller 21 about the roller axis Y2 has a first gear area A21 in which a first gear 21*a* is formed, a first tube area A22 to be in contact with the tube 200, and a groove area A23 in which a groove 21*b* is formed over the whole circumference about the roller axis Y2. The groove area A23 is an area interposed between the first gear area A21 and the first tube area A22 in the direction along the roller axis Y2.

The first drive unit 50 and the second drive unit 60 are accommodated in a casing 80 (accommodating member) illustrated in FIG. 4. At the end of the casing 80, an accommodation unit 82 used for accommodating the first roller unit 10 and the second roller unit 20 is attached. The tube 200 is arranged along the inner circumferential face 82*a* of the accommodation unit 82.

Figure 9:
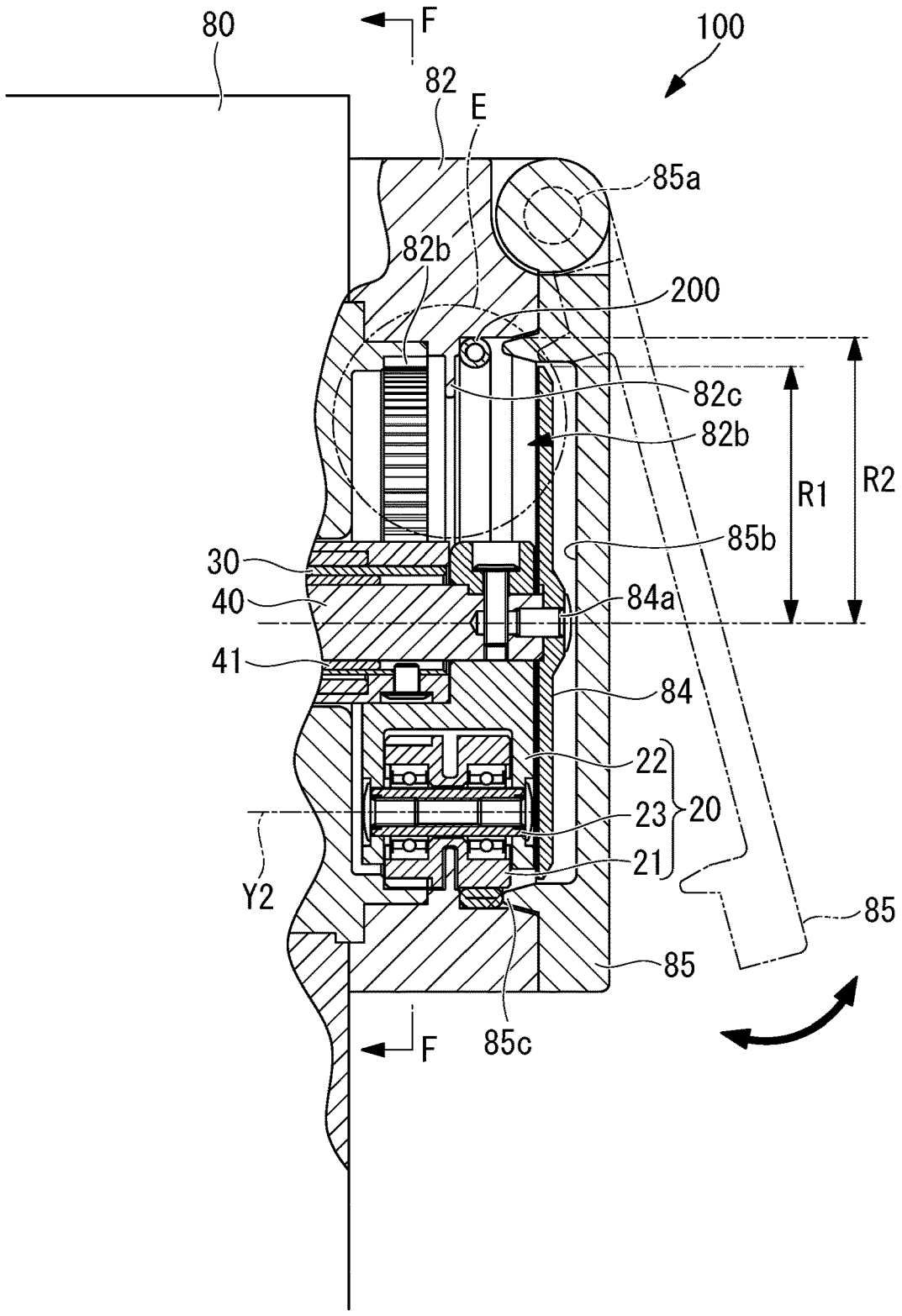
FIG. 9 is a sectional view of the tube pump viewed from the arrow direction of the line B-B of FIG. 2 and illustrates a lid unit in a closed state.
Figure 10:
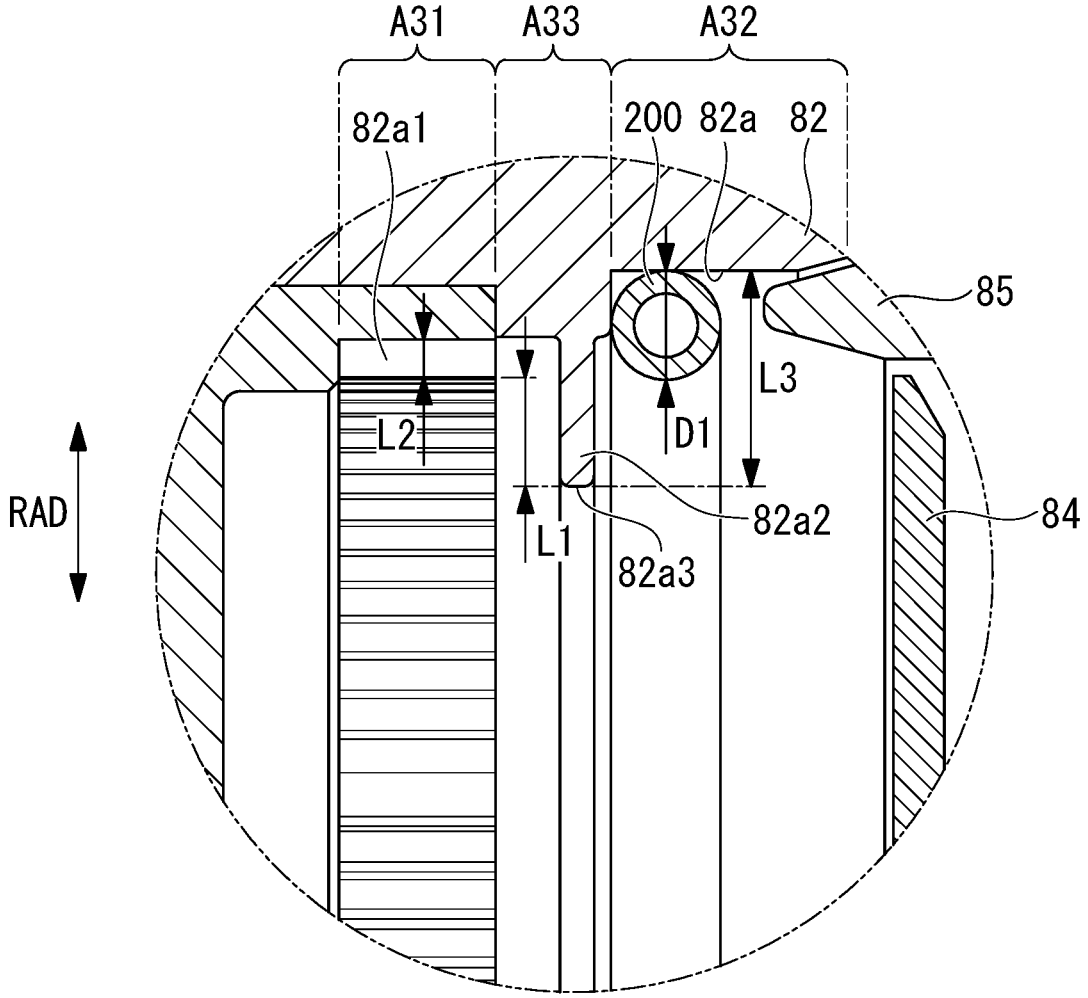
FIG. 10 is a partial enlarged view of a part E of the tube pump illustrated in FIG. 9.

FIG. 9 is a sectional view of the tube pump 100 viewed from the arrow direction of the line B-B of FIG. 2 and illustrates the lid unit 85 in the closed state. FIG. 10 is a partial enlarged view of the part E of the tube pump 100 illustrated in FIG. 9. As illustrated in FIG. 9 and FIG. 10, the inner circumferential face 82*a* of the accommodation unit 82 has a second gear area A31 in which the second gear 82*a*1 engaged with the first gear 11*a* and the first gear 21*a* is formed, a second tube area A32 that pinches and closes the tube 200 between the first tube area A12 and the first tube area A22, and a protruding area A33 in which a protruding part 82*a*2 is formed in a part about the axis X1. The protruding area A33 is an area imposed between the second gear area A31 and the second tube area A32 in the direction along the axis X1.

As illustrated in FIG. 9 and FIG. 10, in the radial direction RAD orthogonal to the axis X1, a tip 82*a*3 of the protruding part 82*a*2 is arranged at a position more projecting toward the axis X1 than the second gear 82*a*1. The projecting length L1 of the tip 82*a*3 of the protruding part 82*a*2 from the second gear 82*a*1 in the radial direction RAD is longer than the tooth depth L2 of the second gear 82*a*1. The projecting length L1 is preferably more than or equal to twice the tooth depth L2 and less than or equal to three times the tooth depth L2. Further, the distance L3 in the radial direction RAD from the inner circumferential face 82*a* of the second tube area A32 of the accommodation unit 82 to the tip 82*a*3 of the protruding part 82*a*2 is preferably more than or equal to 1.5 times the outer diameter D1 of the tube 200 and less than or equal to twice the outer diameter D1 of the tube 200.

Figure 11:
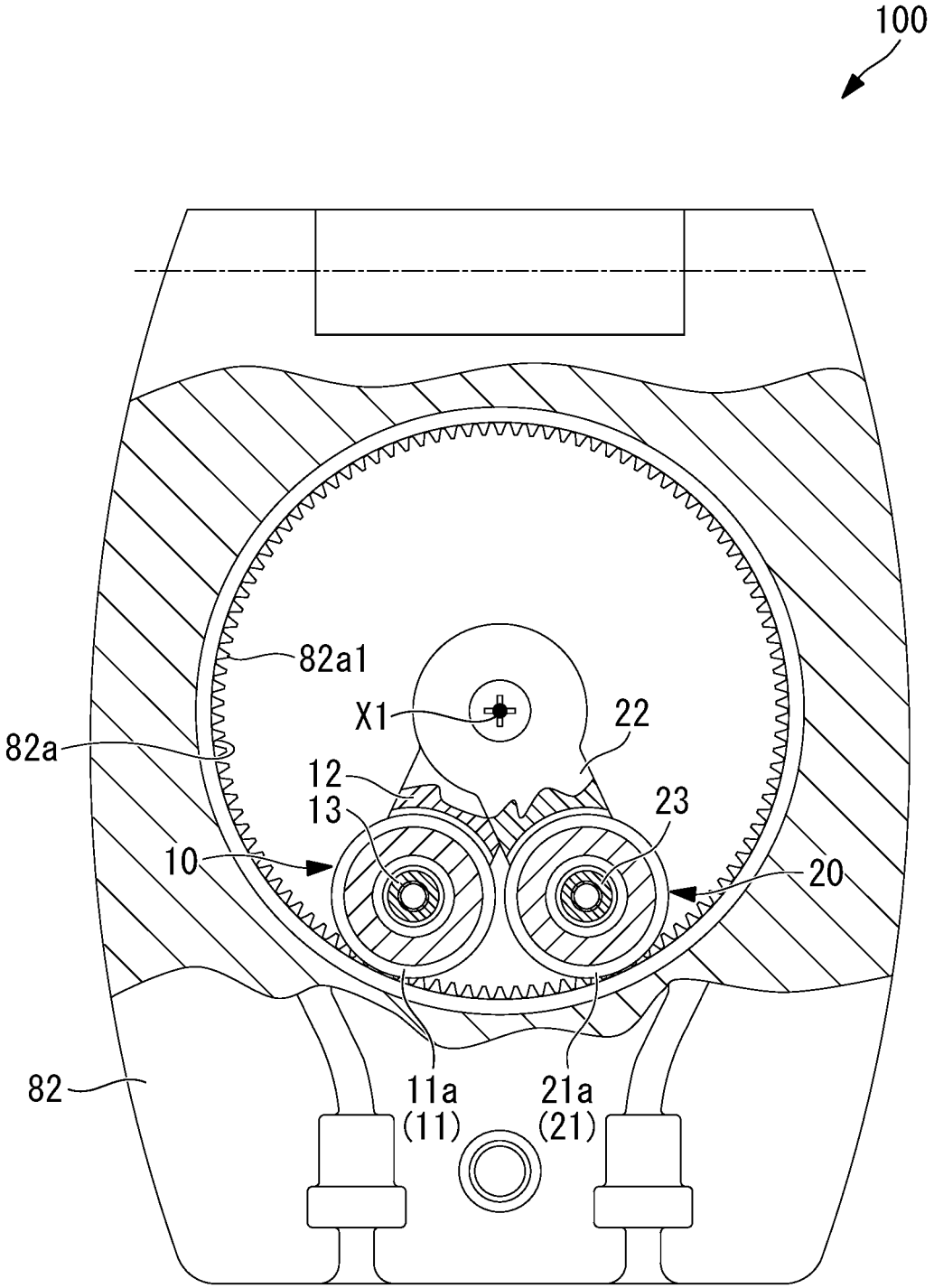
FIG. 11 is a sectional view of the tube pump viewed from the arrow direction of the line F-F of FIG. 9.

FIG. 11 is a sectional view of the tube pump 100 viewed from the arrow direction of the line F-F of FIG. 9. As illustrated in FIG. 11, a second gear 82*a*1 is formed on the inner circumferential face 82*a* of the accommodation unit 82 over the whole circumference about the axis X1. By engaging the first gear 11*a* of the first roller unit 10 with the second gear 82*a*1, it is possible to reduce misalignment of the first roller unit 10 when the first roller unit 10 is rotated about the axis X1. Similarly, by engaging the first gear 21*a* of the second roller unit 20 with the second gear 82*a*1, it is possible to reduce misalignment of the second roller unit 20 when the second roller unit 20 is rotated about the axis X1.

Figure 12:
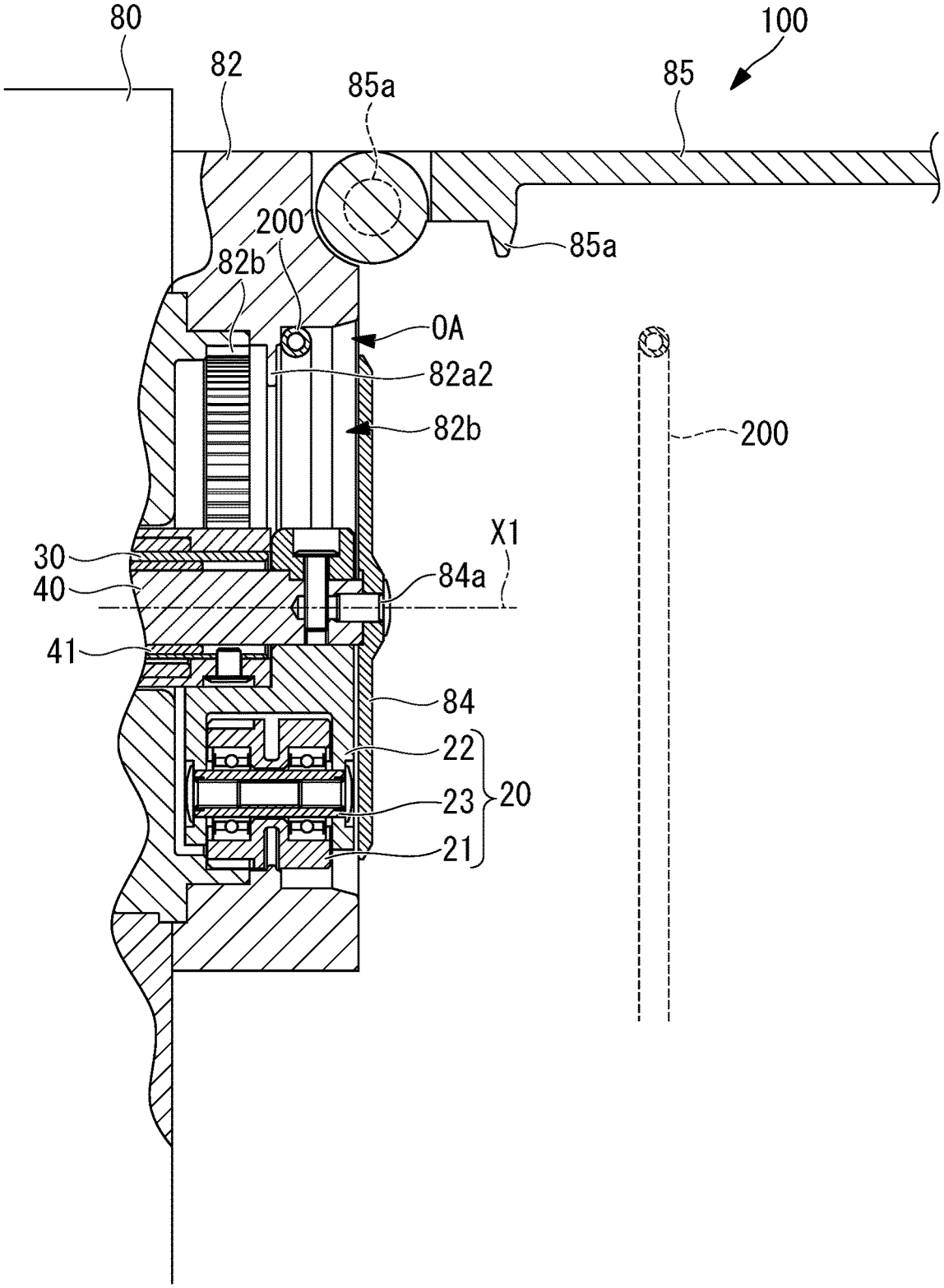
FIG. 12 is a sectional view of the tube pump viewed from the arrow direction of the line B-B of FIG. 2 and illustrates a lid unit in an open state.

FIG. 12 is a sectional view of the tube pump 100 viewed from the arrow direction of the line B-B of FIG. 2 and illustrates the lid unit 85 in the open state. As illustrated in FIG. 12, when the tube 200 is attached to the accommodation unit 82 of the tube pump 100 of the present embodiment, the operator may hold the tube 200 at a position separated from the cover member 84 (the position indicated by the dotted line) and insert the tube 200 into the recess 82*b* of the accommodation unit 82 from an opening area OA.

In the tube pump 100 of the present embodiment, the protruding part 82*a*2 is formed on the inner circumferential face 82*a*. Thus, when the tube 200 is deformed such as when the tube 200 to be attached to the tube pump 100 is partially twisted, even when the tube 200 inserted into the recess 82*b* of the accommodation unit 82 is forced to move from the second tube area A32 toward the second gear area A31, such motion is prevented by the protruding part 82*a*2.

Figure 13:
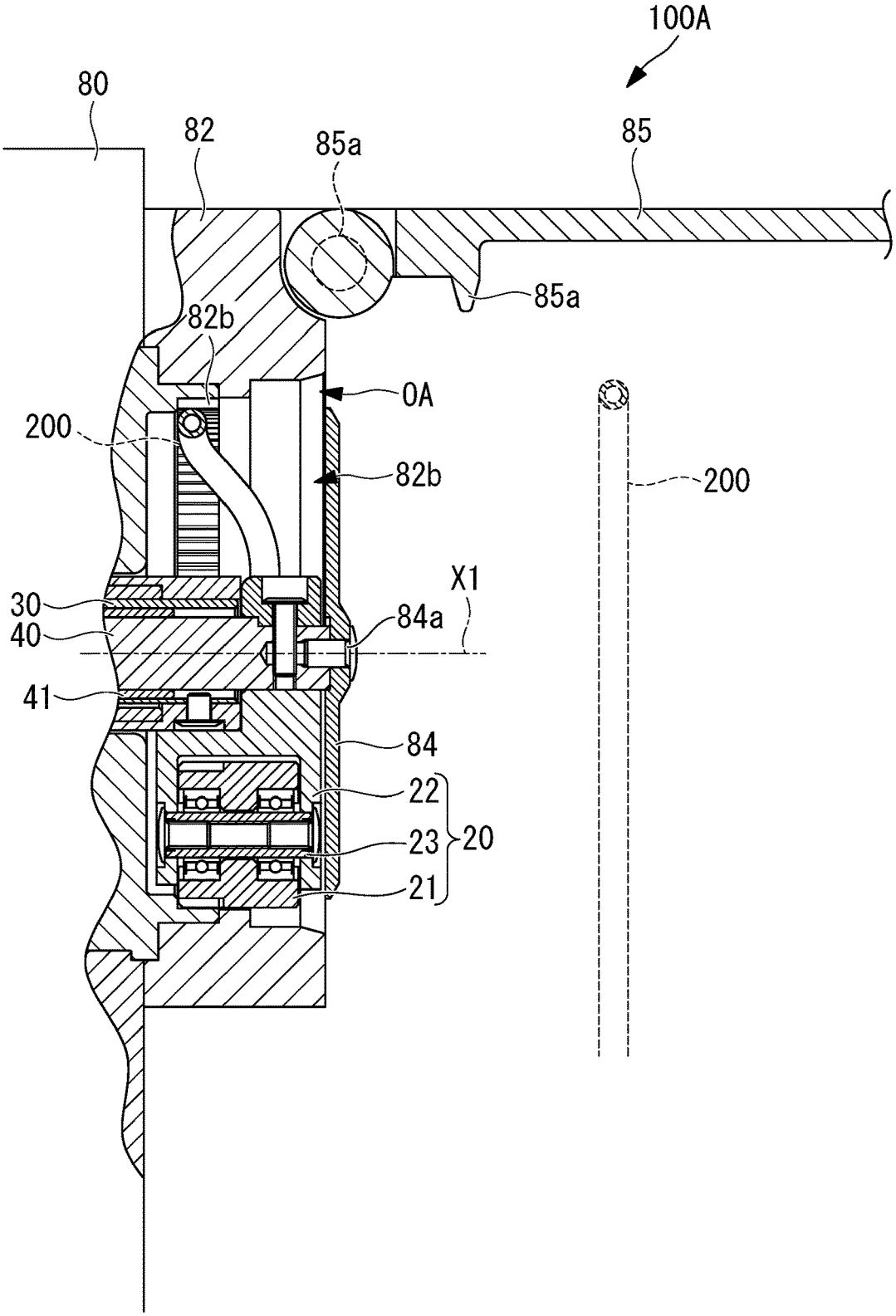
FIG. 13 is a sectional view illustrating a tube pump of a comparative example.

FIG. 13 is a sectional view illustrating a tube pump 100A of a comparative example. The tube pump 100A of the comparative example differs from the tube pump 100 of the present embodiment in that no protruding part 82*a*2 is formed on the inner circumferential face 82*a*. As illustrated in FIG. 13, when the tube 200 is attached to the accommodation unit 82 of the tube pump 100A of the comparative example, the operator may hold the tube 200 at a position separated from the cover member 84 (the position indicated by the dotted line) and insert the tube 200 into the recess 82*b* of the accommodation unit 82 from the opening area OA.

In the tube pump 100A of the comparative example, no protruding part 82*a*2 is formed on the inner circumferential face 82*a*. Thus, the tube 200 inserted in the recess 82*b* of the accommodation unit 82 may move from the second tube area A32 toward the second gear area A31 when the tube 200 is deformed such as when the tube 200 to be attached to the tube pump 100A is partially twisted.

As indicated by the dotted line in FIG. 13, when the tube 200 inserted into the recess 82*b* of the accommodation unit 82 moves from the second tube area A32 toward the second gear area A31, the tube 200 will be arranged at a position distant from the cover member 84. In such a case, the operator is unable to insert its finger into the second gear area A31 through the opening area OA, and it is thus required to remove the cover member 84 and then reattach the tube 200 to the tube pump 100A.

As illustrated in FIG. 1 and FIG. 2, the protruding part 82*a*2 formed on the inner circumferential face 82*a* of the accommodation unit 82 is formed in an area other than a non-formation area AN about the axis X1. As illustrated in FIG. 2, the non-formation area AN is an area interposed between the first roller unit 10 and the second roller unit 20 in the tube replacement mode (second control mode) described later. Further, the non-formation area AN is an area where the tube 200 is not arranged in a state where the tube 200 is arranged in the accommodation unit 82.

As illustrated in FIG. 1, in a discharge control mode (first control mode) described later, the first roller unit 10 rotates about the axis X1 in a state where the protruding part 82*a*2 is accommodated in the groove 11*b* of the first roller 11. Similarly, in the discharge control mode (first control mode), the second roller unit 20 rotates about the axis X1 in a state where the protruding part 82*a*2 is accommodated in the groove 21*b* of the second roller 21.

As illustrated in FIG. 2, in a tube replacement mode (second control mode) described later, the end 82*a*4 in the circumferential direction about the axis X1 of the protruding part 82*a*2 is accommodated in the groove 11*b* of the first roller unit 10. Similarly, in the tube replacement mode (second control mode), the end 82*a*5 in the circumferential direction about the axis X1 of the protruding part 82*a*2 is accommodated in the groove 21*b* of the second roller unit 20.

Next, the cover member 84 and the lid unit 85 of the tube pump 100 of the present embodiment will be described with reference to the drawings. As illustrated in FIG. 9, the tube pump 100 of the present embodiment includes the cover member 84 arranged in the recess 82*b* of the accommodation unit 82 and the lid unit 85 that can be switched between the open and closed states.

The cover member 84 is a member to prevent the operator from touching a part near the first roller unit 10 and the second roller unit 20 with its hand and the operator's finger from being caught between the first roller unit 10 and the second roller unit 20 when the lid unit 85 is in the open state. Since the first roller unit 10 and the second roller unit 20 of the present embodiment are independently rotatable about the axis X1, the rotation angle between the first roller unit 10 and the second roller unit 20 about the axis X1 (angle θ in FIG. 1) changes from a wide state to a narrow state. Accordingly, in the present embodiment, the cover member 84 is provided to prevent the problem of the operator's finger being caught.

As illustrated in FIG. 9, the cover member 84 is provided to cover the first roller unit 10 and the second roller unit 20 and fastened to the drive shaft 40 by a fastening screw 84*a*. The cover member 84 is a member that is formed in a round shape in plan view with a radius R1 centered on the axis X1 passing through the center of the drive shaft 40. In FIG. 9, the second tube area A32 of the arcuate inner circumferential face 82*a* where the tube 200 is arranged is a surface arranged along a circle of a radius R2 centered on the axis X1.

As illustrated in FIG. 2, an area from the radius R1 to the radius R2 centered on the axis X1 is the circular ring-shaped opening area OA. The tube pump 100 illustrated in FIG. 2 is illustrated in a retraction state where the angle of rotation of the first roller unit 10 and the second roller unit 20 about the axis X1 is fixed and both the first roller unit 10 and the second roller unit 20 are not in contact with the tube 200.

As illustrated in FIG. 2, the tube 200 has the outer diameter D1 in the natural state at the position where the first roller unit 10 and the second roller unit 20 are not in contact with each other. The outer diameter D1 is smaller than the difference obtained by subtracting radius R1 from radius R2. Thus, in the opening area OA, the tube 200 can be inserted toward the inner circumferential face 82*a*.

As illustrated in FIG. 4, the cover member 84 is arranged in the recess 82*b* of the accommodation unit 82 so as to cover the first roller shaft 13 and the second roller shaft 23. Even when the first roller 11 and the second roller 21 come closer to or come into contact with each other in the rotation direction RD about the axis X1, the first roller 11 and the second roller 21 come closer to or come into contact with each other in the area covered by the cover member 84. It is thus possible to prevent a problem of the operator's finger being caught between the first roller 11 and the second roller 21 when these rollers come closer to or come into contact with each other.

As illustrated in FIG. 9, the lid unit 85 is a member that can be switched between the closed state (indicated by the solid line) in which the lid unit 85 covers the entire area of the recess 82*b* of the accommodation unit 82 (the area of radius R2 centered on the axis X1) and the open state (indicated by the dotted line) in which the lid unit 85 is separated from the recess 82*b*. The lid unit 85 has a connecting part 85*a* connected to the accommodation unit 82, a recess 85*b* that accommodates the cover member 84 in the closed state, and the protruding part 85*c* formed in a circular ring shape so as to project toward the recess 82*b* of the accommodation unit 82 in the closed state.

The lid unit 85 is connected to the accommodation unit 82 by a connecting part 85*a*. The lid unit 85 can be swung about the connecting part 85*a*. The operator may grasp and lift the tip of the lid unit 85 in the closed state upward to swing the lid unit 85 about the connecting part 85*a* to switch the lid unit 85 to the open state.

As illustrated in FIG. 9, the protruding part 85*c* is arranged in a circular ring shape to come into contact with the tube 200 arranged along the inner circumferential face 82*a* of the accommodation unit 82 when the lid unit 85 is in the closed state. The protruding part 85*c* is arranged so that the tube 200 remains pinched between the first roller 11 or the second roller 21 and the inner circumferential face 82*a* of the accommodation unit 82.

As illustrated in FIG. 1 and FIG. 2, the tube pump 100 of the present embodiment includes the open/closure detection sensor (detection unit) 86 that detects the open state and the closed state of the lid unit 85. The open/closure detection sensor 86 is a sensor that is in the ON state when the lid unit 85 is arranged in a close position and is in the OFF state when the lid unit 85 is arranged in a separated position.

Since the operator puts the lid unit 85 in the open state when replacing the tube 200 or the like, the operator's finger may be caught between the first roller unit 10 and the second roller unit 20 when the first drive unit 50 and the second drive unit 60 remain in operation. In the present embodiment, since the first drive unit 50 and the second drive unit 60 are stopped when the lid unit 85 is in the open state, it is possible to prevent the problem of the operator's finger being caught between the first roller unit 10 and the second roller unit 20.

Note that the tube pump 100 of the present embodiment includes the cover member 84 arranged in the recess 82*b* so as to cover the first roller unit 10 and the second roller unit 20. Thus, even when the first roller unit 10 and the second roller unit 20 do not stop immediately after the lid unit 85 is switched from the closed state to the open state or even when some malfunction occurs, it is possible to prevent the problem of the operator's finger being caught between the first roller unit 10 and the second roller unit 20.

Further, in the above description, the tube pump 100 includes the open/closure detection sensor 86 to stop the first drive unit 50 and the second drive unit 60 when the lid unit 85 is in the open state, but other forms may be used. For example, the tube pump 100 may be configured such that the open/closure detection sensor 86 is not provided and the first drive unit 50 and the second drive unit 60 do not stop even when the lid unit 85 is in the open state. Even in such a case, since the tube pump 100 includes the cover member 84, it is possible to prevent the problem of the operator's finger being caught between the first roller unit 10 and the second roller unit 20.

The tube pump 100 of the present embodiment can perform a discharge control mode (first control mode) in which the control unit 95 controls the first drive unit 50 and the second drive unit 60 to rotate the first roller unit 10 and the second roller unit 20 in the same direction to discharge the fluid out of the tube 200 by the first roller unit 10 and the second roller unit 20.

When the discharge control mode is performed, the operator may set a flow rate of a liquid to be discharged by the tube pump 100 to the outflow side 200*b* via the input unit 96. The control unit 95 controls the first drive unit 50 and the second drive unit 60 so that an amount of the liquid at the set flow rate is discharged to the outflow side 200*b*.

Further, the tube pump 100 of the present embodiment can perform the tube replacement mode (second control mode)

in which the control unit 95 controls the first drive unit 50 and the second drive unit 60 to fix respective rotation angles of the first roller unit 10 and the second roller unit 20 so that the first roller unit 10 and the second roller unit 20 are not in contact with the tube 200.

When the tube replacement mode is performed, the operator may provide an instruction to perform the tube replacement mode via the input unit 96. As illustrated in FIG. 2, the control unit 95 fixes respective rotation angles of the first roller unit 10 and the second roller unit 20 so that the first roller unit 10 and the second roller unit 20 are not in contact with the tube 200.

The effects and advantages achieved by the tube pump 100 of the present embodiment described above will be described.

According to the tube pump 100 of the present embodiment, the first roller unit 10 rotates about the axis X1 in a state where the first gear 11*a* formed in the first gear area A11 of the first roller 11 and the second gear 82*a*1 formed in the second gear area A31 of the accommodation unit 82 are engaged with each other. Further, the second roller unit 20 rotates about the axis X1 in a state where the first gear 21*a* formed in the first gear area A21 of the second roller 21 and the second gear 82*a*1 formed in the second gear area A31 of the accommodation unit 82 are engaged with each other. Because the first gear 11*a* and the second gear 82*a*1 are engaged with each other, the first roller 11 can be rotated about the first roller shaft 13 in the opposite direction to the rotation direction RD of the first roller unit 10 when the first roller unit 10 rotates about the axis X1.

Accordingly, it is possible to prevent a failure that the first roller 11 in contact with the tube 200 pushes the tube 200 in the rotation direction RD of the first roller unit 10 and causes the tube 200 to be deformed. Similarly, because the first gear 21*a* and the second gear 82*a*1 are engaged with each other, the second roller 21 can be rotated about the second roller shaft 23 in the opposite direction to the rotation direction RD of the second roller unit 20 when the second roller unit 20 rotates about the axis X1. Accordingly, it is possible to prevent a failure that the second roller 21 in contact with the tube 200 pushes the tube 200 in the rotation direction RD of the second roller unit 20 and causes the tube 200 to be deformed.

Further, the tube 200 is pinched and closed between the first tube area A12 of the first roller 11 and the second tube area A32 of the accommodation unit 82, the tube 200 is pinched and closed between the first tube area A22 of the second roller 21 and the second tube area A32 of the accommodation unit 82, and thereby a liquid in the tube 200 can be transported in the rotation direction RD about the axis X1 of the first roller unit 10 and the second roller unit 20.

Further, according to the tube pump 100 of the present embodiment, the protruding part 82*a*2 is formed in the protruding area A33 between the second gear area A31 and the second tube area A32 of the accommodation unit 82, and the tip 82*a*3 of the protruding part 82*a*2 is arranged at a position more projecting toward the axis X1 than the second gear 82*a*1. Thus, when the tube 200 is deformed such as when the tube 200 to be attached to the tube pump 100 is partially twisted, even when the tube 200 inserted in the accommodation unit 82 is forced to move from the second tube area A32 toward the second gear area A31, such motion is prevented by the protruding part 82*a*2. Thus, even when the tube 200 is deformed such as when the tube 200 attached to the tube pump 100 is partially twisted, the tube 200 can be reliably arranged at a position where the tube 200 can be collapsed by the first roller unit 10 and the second roller unit 20.

Further, according to the tube pump 100 of the present embodiment, since the projecting length L1 of the tip 82*a*3 of the protruding part 82*a*2 from the second gear area A31 is more than or equal to twice the tooth depth L2 of the second gear 82*a*1, it is possible to more reliably prevent the tube 200 inserted in the accommodation unit 82 from moving from the second tube area A32 toward the second gear area A31.

Further, according to the tube pump 100 of the present embodiment, the cover member 84 is arranged in the accommodation unit 82 so as to provide the circular ring-shaped opening area OA into which the tube 200 can be inserted toward the inner circumferential face 82*a*. This prevents the operator's finger from being caught between the first roller unit 10 and the second roller unit 20. Further, since the tube 200 can be inserted from the opening area OA toward the inner circumferential face 82*a* of the accommodation unit 82, the operator may easily replace the tube 200.

Further, according to the tube pump 100 of the present embodiment, the control unit 95 performs the second control mode, thereby both the first roller unit 10 and the second roller unit 20 are arranged at retracted positions where both of them are not in contact with the tube 200. This enables easy replacement of the tube 200 in use with another tube 200.

Further, according to the tube pump 100 of the present embodiment, the non-formation area AN where the protruding part 82*a*2 is not formed is an area which is pinched by the first roller unit 10 and the second roller unit 20 whose rotation angles are fixed in the second control mode and in which the tube 200 is not arranged. Since the protruding part 82*a*2 is formed in an area where the tube 200 is arranged, it is possible to suitably prevent the tube 200 inserted in the accommodation unit 82 from moving from the second tube area A32 toward the second gear area A31 in the second control mode.

Further, according to the tube pump 100 of the present embodiment, since the ends 82*a*4, 82*a*5 in the circumferential direction about the axis X1 of the protruding part 82*a*2 are accommodated in respective grooves 11*b*, 21*b* of the first roller unit 10 and the second roller unit 20, motion of the tube 200 from the non-formation area AN toward the second gear area A31 can be reliably prevented by the first roller unit 10 and the second roller unit 20.

Further, according to the tube pump 100 of the present embodiment, since the lid unit 85 covers the accommodation unit 82 in the closed state, it is possible to reliably prevent a problem of the operator accidentally touching a part near the first roller unit 10 and the second roller unit 20 with its hand and thereby its finger being caught therebetween. Further, since the first drive unit 50 and the second drive unit 60 are stopped when the open/closure detection sensor 86 detects that the lid unit 85 is in the open state, the first roller unit 10 and the second roller unit 20 do not rotate about the axis X1 in a state where the operator may touch a part near the first roller unit 10 and the second roller unit 20. Accordingly, it is possible to prevent the operator's finger from being caught between the first roller unit 10 and the second roller unit 20.

What is claimed is:

1. A tube pump comprising:

a pair of roller units configured to rotate about an axis while being in contact with a flexible tube;

an accommodation unit accommodating the pair of roller units and opened toward one end side in an axis direction along the axis, the flexible tube being arranged in the accommodation unit; and a pair of drive units configured to rotate the pair of roller units in the same direction about the axis, respectively, wherein each of the roller units includes a roller configured to rotate about a roller axis, wherein an outer circumferential face of the roller is configured to include a first gear area in which a first gear is formed, a first tube area to be contacted with the tube, and a groove area in which a groove is formed about the roller axis between the first gear area and the first tube area, wherein the accommodation unit includes an inner circumferential face formed in a shape of a circular arc about the axis, wherein the inner circumferential face of the accommodation unit is configured to include a second gear area in which a second gear configured to engage with the first gear is formed, a second tube area configured to pinch and close the tube between the first tube area and the second tube area, and a protruding area in which a protruding part is formed about the axis between the second gear area and the second tube area in the axis direction, wherein the pair of roller units is configured to rotate about the axis with the protruding part being accommodated in the groove, wherein a tip of the protruding part is arranged at a position more projecting toward the axis than the second gear, and wherein a projecting length of the tip of the protruding part from the second gear is more than or equal to twice a tooth depth of the second gear.

2. The tube pump according to claim 1, wherein a distance in a radial direction orthogonal to the axis from the inner circumferential face of the second tube area of the accommodation unit to the tip of the protruding part is more than or equal to 1.5 times an outer diameter of the tube and less than or equal to twice the outer diameter of the tube.

3. The tube pump according to claim 2 further comprising a cover member covering the pair of roller units and arranged in the accommodation unit so as to provide a circular ring-shaped opening area into which the tube is to be inserted toward the inner circumferential face.

4. The tube pump according to claim 1 further comprising a control unit configured to control each of the pair of drive units, wherein the control unit is configured to perform a first control mode to rotate the pair of roller units in the same direction so as to discharge a fluid out of the tube and a second control mode to fix respective rotation angles of the pair of roller units so that the pair of roller units do not come into contact with the tube.

5. The tube pump according to claim 4, wherein the protruding part is formed in an area other than a non-formation area about the axis, and wherein the non-formation area is an area interposed between the pair of roller units in the second control mode, the tube being not arranged in the non-formation area.

6. The tube pump according to claim 5, wherein in the second control mode, both ends in a circumferential direction about the axis of the protruding part are accommodated in the groove of each of the pair of roller units.

7. The tube pump according to claim 1 further comprising:

a lid unit configured to be switched between a closed state where the lid unit covers the accommodation unit and an open state where the lid unit is separated from the accommodation unit;

a detection unit configured to detect the open state and the closed state of the lid unit; and a control unit configured to control each of the pair of drive units, wherein the control unit is configured to control the pair of drive units to stop when the detection unit detects that the lid unit is in the open state.

* * * * *